US008297887B2

(12) United States Patent
Ness et al.

(10) Patent No.: US 8,297,887 B2
(45) Date of Patent: Oct. 30, 2012

(54) MASONRY BLOCK WITH LEVELING PADS

(75) Inventors: John T. Ness, Stillwater, MN (US); Jeffrey A. Ness, Oak Park Heights, MN (US)

(73) Assignee: Ness Inventions, Inc., St. Paul, MN (US)

( * ) Notice: Subject to any disclaimer, the term of this patent is extended or adjusted under 35 U.S.C. 154(b) by 337 days.

(21) Appl. No.: 12/251,301

(22) Filed: Oct. 14, 2008

(65) Prior Publication Data

US 2009/0208298 A1 Aug. 20, 2009

Related U.S. Application Data

(60) Provisional application No. 60/979,268, filed on Oct. 11, 2007.

(51) Int. Cl.
*E02D 29/02* (2006.01)
*E04C 1/00* (2006.01)

(52) U.S. Cl. ..... 405/286; 52/604

(58) Field of Classification Search ..... 405/284, 405/286; 52/596, 604
See application file for complete search history.

(56) References Cited

U.S. PATENT DOCUMENTS 5,173,003 A * 12/1992 Hair ..... 404/41
5,337,527 A * 8/1994 Wagenaar ..... 52/169.2
5,402,609 A * 4/1995 Kelley, Jr. ..... 52/98
5,421,135 A * 6/1995 Stevens et al. ..... 52/604
5,471,808 A * 12/1995 De Pieri et al. ..... 52/603
5,490,363 A * 2/1996 Woolford ..... 52/604
5,493,816 A * 2/1996 Willemsen ..... 52/2.11
5,505,034 A * 4/1996 Dueck ..... 52/604
5,535,568 A * 7/1996 Quinn ..... 52/608
5,560,173 A * 10/1996 Scheiwiller ..... 52/608
5,615,529 A * 4/1997 Johnson et al. ..... 52/604
5,651,642 A * 7/1997 Kelley et al. ..... 405/286
5,832,687 A * 11/1998 Willemsen ..... 52/592.6
5,866,026 A * 2/1999 Johnston ..... 249/119
5,934,037 A * 8/1999 Bundra ..... 52/603
5,941,042 A * 8/1999 Dueck ..... 52/604
5,951,210 A * 9/1999 Maguire et al. ..... 405/286
6,233,897 B1 * 5/2001 Jurik ..... 52/604
6,679,656 B1 * 1/2004 Manthei ..... 405/284
6,948,282 B2 * 9/2005 Bott ..... 52/98
7,267,321 B1 * 9/2007 Morrell ..... 249/102
2001/0019684 A1 * 9/2001 Manthei et al. ..... 405/284
2004/0134154 A1 * 7/2004 Bott ..... 52/604

* cited by examiner

*Primary Examiner* — Tara Mayo-Pinnock

(74) *Attorney, Agent, or Firm* — Dicke, Billig & Czaja PLLC

(57) ABSTRACT

A block having a top surface, a bottom surface opposing the top surface, a front surface, a rear surface opposing the front surface, the front and rear surfaces extending between the top and bottom surfaces, a first side surface, a second side surface opposing the first side surface, the first and second side surfaces extending between the front and rear surfaces, and a set of at least three leveling pads extending from the rear surface.

9 Claims, 11 Drawing Sheets

MASONRY BLOCK WITH LEVELING PADS

CROSS-REFERENCE TO RELATED APPLICATION

The subject matter of this application is related to the subject matter of U.S. Provisional Patent Application No. 60/979,268, filed Oct. 11, 2007, priority to which is claimed under 35 U.S.C. §119(e) and which is incorporated herein by reference.

BACKGROUND OF THE INVENTION

Concrete retaining wall blocks are used to build any number of landscape structures, such as, for example, raised planting beds and soil retention walls. These structures are generally formed by stacking the retaining wall blocks on top of one another in successive courses. During assembly of such retention or retaining walls, loose dirt often finds its way onto surfaces of the blocks. When the next course is placed on top of the already placed blocks, due to the dirt or other debris, the lower surfaces of the blocks of the upper course are not flush with the upper surfaces of the blocks of the preceding or lower course. This causes the blocks to sit unevenly and create uneven loading or point loads on the blocks. Such loads can become quite large depending on the height of the retaining wall being assembled and the amount of load being retained. In fact, in some instances, the unevenly distributed loads and point loads can cause vertical cracks in or even break the retaining wall blocks, thereby potentially compromising the structural integrity of the retaining wall.

SUMMARY OF THE INVENTION

One embodiment provides a masonry block having a top surface, a bottom surface opposing the top surface, a front surface, a rear surface opposing the front surface, the front and rear surfaces extending between the top and bottom surfaces, a first side surface, a second side surface opposing the first side surface, the first and second side surfaces extending between the front and rear surfaces, and a set of at least three leveling pads extending from the rear surface. According to one embodiment, the set of at least three leveling pads are positioned on the rear surface such that each of the at least three leveling pads are configured to align with a corresponding leveling pad of a at least one similar block of a lower course of blocks when arranged in a plurality of courses of similar blocks to form a structure.

DESCRIPTION OF THE PREFERRED EMBODIMENTS

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

The present disclosure describes a block and wall system that employs blocks having integral leveling pads which create a small space or gap between successive courses of blocks in which errant dirt or debris may be present without adversely affecting contact between the successive courses of blocks, and which are arranged so as to form vertically aligned loading points.

Figure 1:
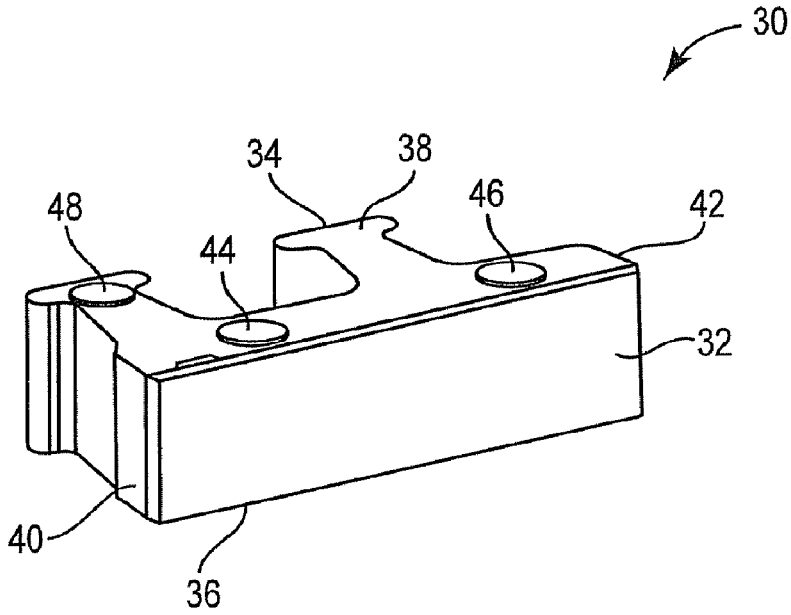
FIG. 1 is a perspective view of a right-hand block according to one embodiment.
Figure 2:
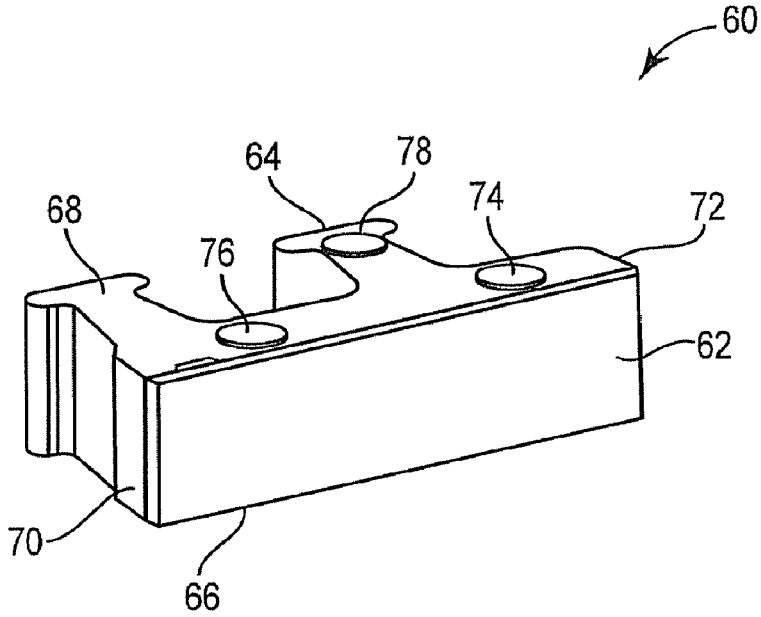
FIG. 2 is a perspective view of a left-hand block according to one embodiment.

FIGS. 1 and 2 respectively illustrate perspective views of what are referred to herein as a right hand block 30 and a left hand block 60, according to one embodiment. Right hand block 30 has a front surface 32, a rear surface 34, a top surface 36, a bottom surface 38, a first end surface 40, and a second end surface 42. According to one embodiment, a set of three leveling pads 44, 46, and 48 extend from bottom surface 38. Similarly, left hand block 60 has a front surface 62, a rear surface 64, a top surface 66, a bottom surface 68, a first end surface 70, and a second end surface 72. A set of three leveling pads 74, 76 and 78 extend from bottom surface 68.

Figure 3A:
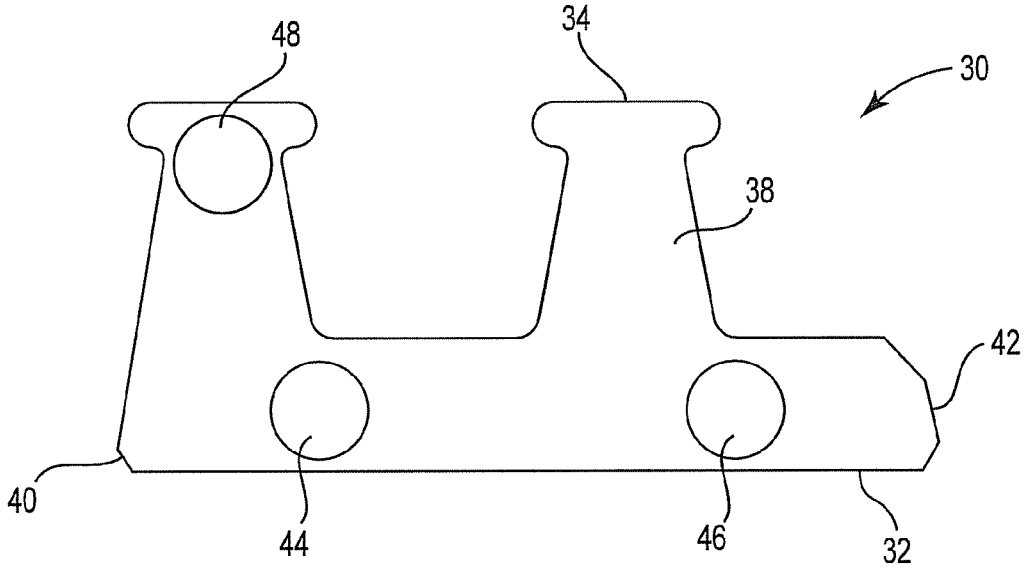
FIG. 3A is a bottom view of the right-hand block of FIG. 1.
Figure 3B:
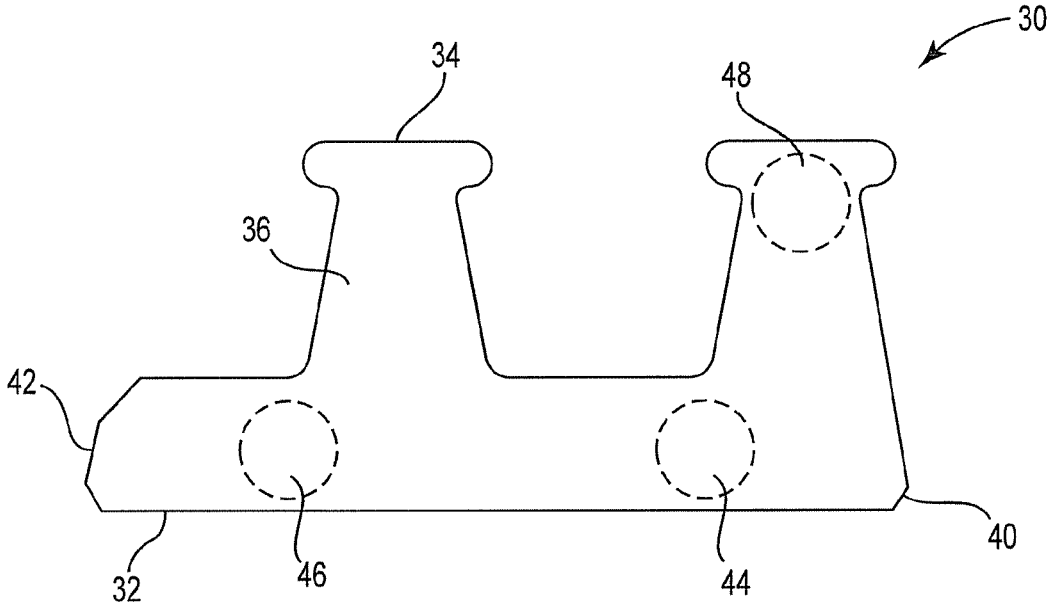
FIG. 3B is a top view of the right-hand block of FIG. 1.
Figure 4A:
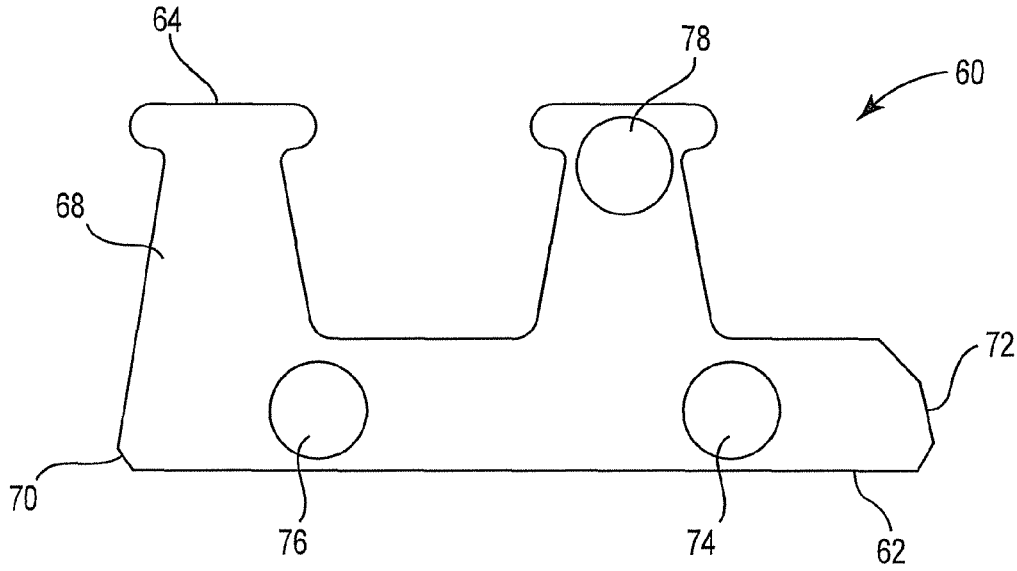
FIG. 4A is a bottom view of the left-hand block of FIG. 2.
Figure 4B:
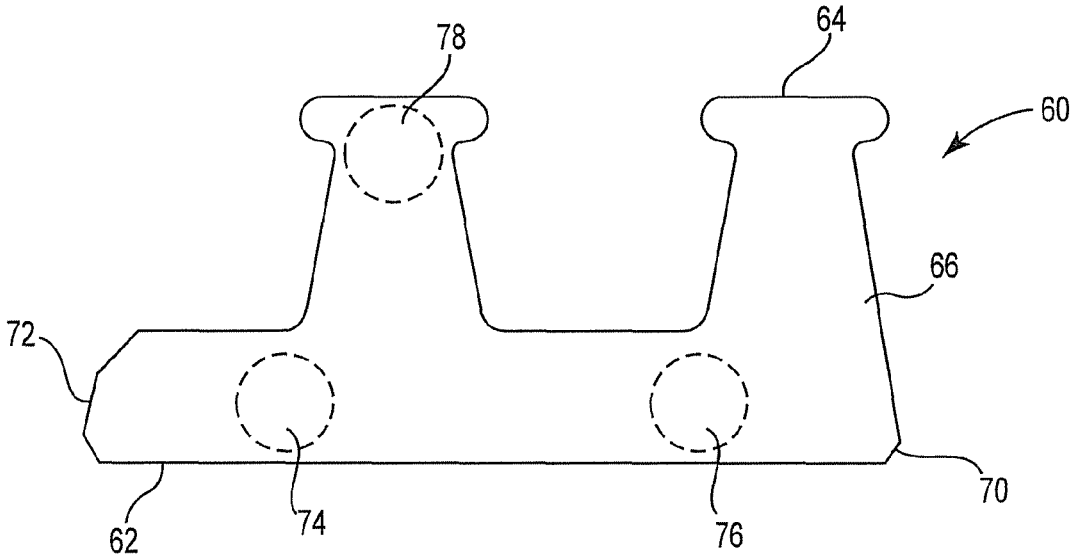
FIG. 4B is a top view of the left-hand block of FIG. 2.

FIGS. 3A and 3B respectively illustrate bottom and top views of right hand block 30, and FIGS. 4A and 4B respectively illustrate bottom and top views of left hand block 60. With reference to FIG. 3B, block 30 is referred to as a right-hand block since, when viewed from front surface 32 and with bottom surface 38 in a downward position, a majority of the leveling pads (i.e. leveling pads 44 and 48) are to the right of a center of block 30. Similarly, with reference to FIG. 4B, block 60 is referred to as a left-hand block since, when viewed from front surface 62 and with bottom surface 68 in a downward position, a majority of the leveling pads (i.e. leveling pads 74 and 78) are to the left of a center of block 60.

Figure 5A:
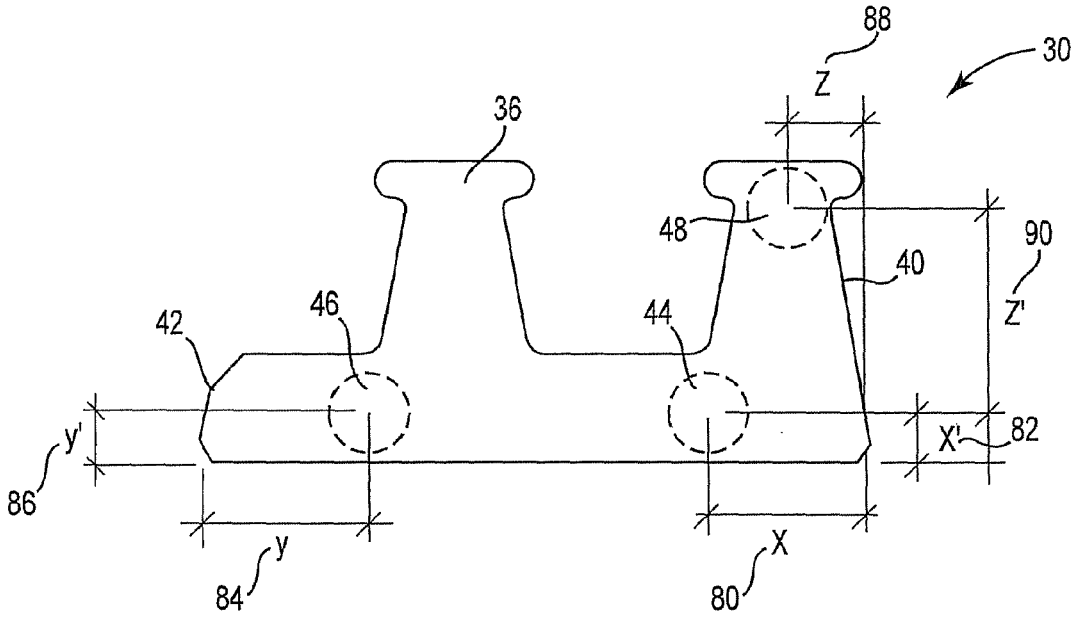
FIG. 5A is a top view of the right-hand block of FIG. 1 illustrating a leveling pad configuration according to one embodiment.
Figure 5B:
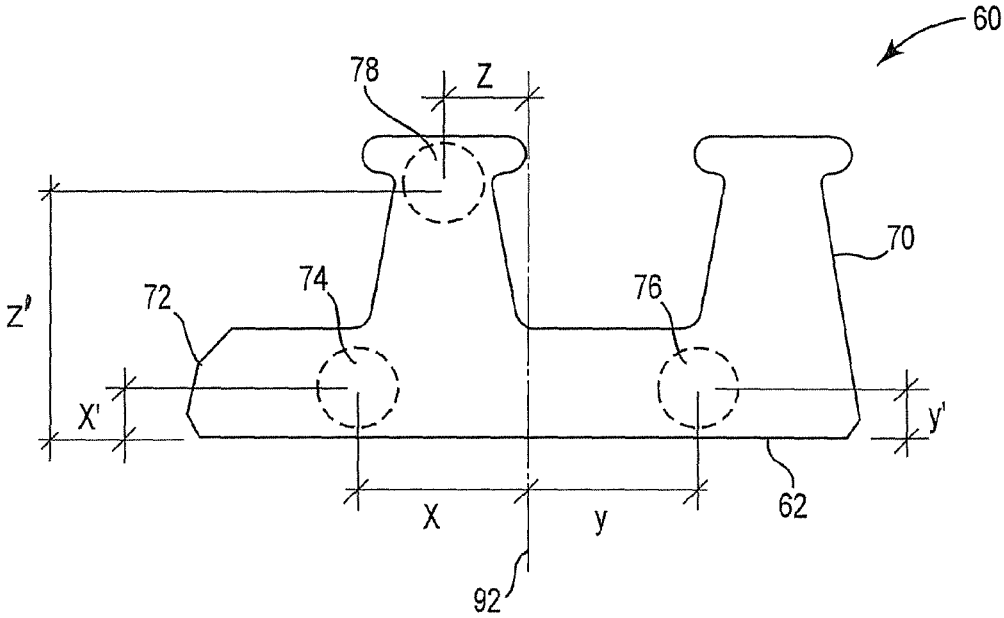
FIG. 5B is a top view of the left-hand block of FIG. 2 illustrating a leveling pad configuration to compliment the leveling pad configuration of the right-hand block of FIG. 5A.

As will be described in greater detail below, leveling pads 44, 46, and 48 of right hand blocks 30 are arranged so as to vertically align with leveling pads 64, 66, and 68 of left hand blocks 60 when right-hand blocks 30 and left-hand blocks 60 are arranged in alternating offset courses to form a structure, such as a soil retaining wall. FIGS. 5A and 5B respectively illustrate top views of right-hand and left-hand blocks 30 and 60 and, as such, leveling pads 44, 46, and 48 of right-hand block 30 and leveling pads 64, 66, and 68 of left hand blocks 60 are illustrated in dashed lines.

With reference to FIG. 5A, according to one embodiment of right-hand block 30, first leveling pad 44 is positioned at a distance X from a right-most portion of first end surface 40, as indicated at 80, and at a distance X' from front surface 32, as indicated at 82. Second leveling pad 46 is positioned at a distance Y from a left-most portion of second end surface 42, as indicated at 84, and at a distance Y' from front surface 32, as indicated at 86. According to one embodiment, distance X' 82 is equal to distance Y' 86, and distance X 80 is equal to distance Y 84, with distances X 80 and Y 84 each being equal to one-fourth a total width of front surface 32 of right-hand block 30. Third leveling pad 48 is positioned at a distance Z from the right-most portion of first end surface 40, as indicated at 88, and at a distance Z' from front surface 32, as indicated 90.

With reference to FIG. 5B, according to one embodiment of left-hand block 60, first leveling pad 74 is positioned at distance X 80 in a direction toward second side surface 72 from a centerline 92 of a width of front surface 62 of left-hand block 40, and at the distance X' 82 from front surface 62. It is noted that right- and left-hand blocks 30 and 60 are of equal dimensions. Second leveling pad 76 is positioned at distance Y 84 in a direction toward first side surface 70 from centerline 92, and at distance Y' from front surface 62. Third leveling pad 78 is positioned at distance Z 88 toward second side surface 72 from centerline 92, and at distance Z' 90 from front surface 62.

By positioning leveling pads 44, 46, and 48 of right-hand block 30 and leveling pads 74, 76, and 78 of left-hand block 40 as described above by FIGS. 5A and 5B, leveling pads 44, 46, and 48 of right-hand block 30 and leveling pads 74, 76, and 78 of left-hand block vertically align with one another when arranged in alternating and offset courses to form a wall structure.

Figure 6:
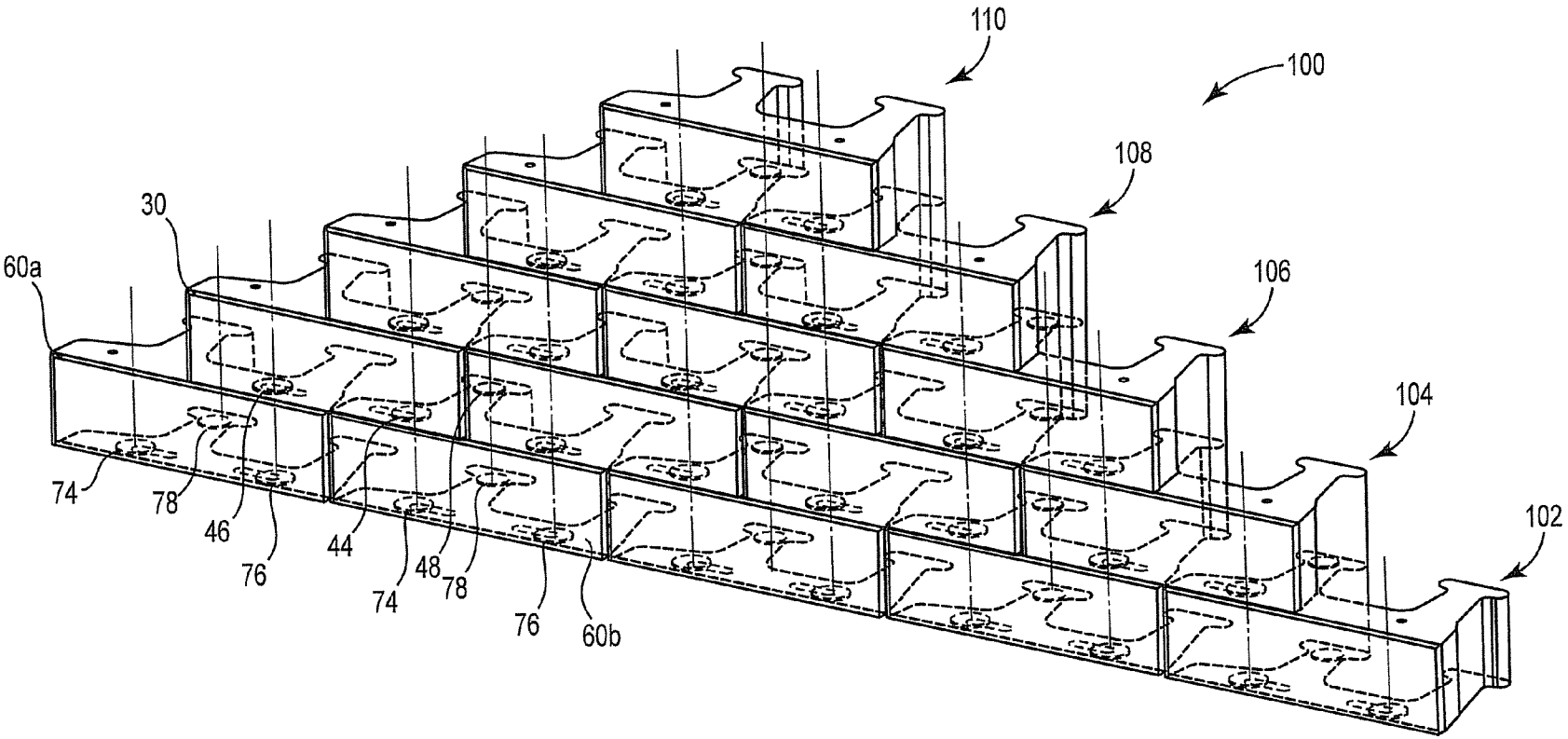
FIG. 6 is a perspective view of a retaining wall assembly formed with the right- and left-hand blocks of FIGS. 1 and 2.

FIG. 6 is a perspective view illustrating a portion of an example retaining wall 100 formed by assembling right- and left-hand blocks 30 and 60 in alternating and off-set courses. Such a configuration, wherein the centerlines of blocks of one course of blocks are aligned with the joints between abutting blocks of the next lower course of blocks, is commonly referred to as running bond pattern. As illustrated, first, third, and fifth courses 102, 106, and 110 comprises left hand blocks 60, and second and fourth courses 104 and 108 comprise right hand blocks 30. The successive rows are staggered such that right-hand blocks 30 are centered on joints between abutting left-hand blocks 60 so that leveling pads 44, 46, and 48 of a right hand block 30 of one course respectively align with leveling pads 74, 76, and 78 of a pair of abutting left hand blocks 40 in the lower or preceding course, as illustrated by right hand block 30 and left hand blocks 60*a* and 60*b* in FIG. 6. In particular, second leveling pad 46 of right-hand block 30 aligns with second leveling pad 76 of first left-hand block 60*a*, and first and third leveling pads 44 and 48 of right-hand block 30 respectively align with first and third leveling pads 74 and 78 of second left-hand block 60*b*.

Leveling pads 44, 46, and 48 of right hand blocks 30 and leveling pads 74, 76, and 78 of left hand blocks 40, create a small space or gap between successive courses of a retaining wall or other structure in which errant dirt or debris may be present without adversely affecting contact between the successive courses of blocks, thereby substantially reducing or eliminating uneven loading and pressure points on the blocks otherwise caused by such debris. Additionally, by vertically aligning with one another, leveling pads 44, 46, and 48 of right hand blocks 30 and leveling pads 74, 76, and 78 of left hand blocks 40 form a 3-point loading system for each block which vertically transfer loads through retaining wall 100 (or other structure) to ground. Transferring loads along the vertical lines of the 3-point loading system created by leveling pads 44, 46, and 48 of right-hand blocks 30 and leveling pads 74, 76, and 78 of left-hand blocks 60 increases the load bearing capacity of the blocks (and thus of wall 100) as compared to similar blocks not employing leveling pads, whose load capacities are adversely impacted by uneven loading and pressure points caused by the presence of dirt and other debris between the surfaces of successive courses of blocks.

Figure 7:
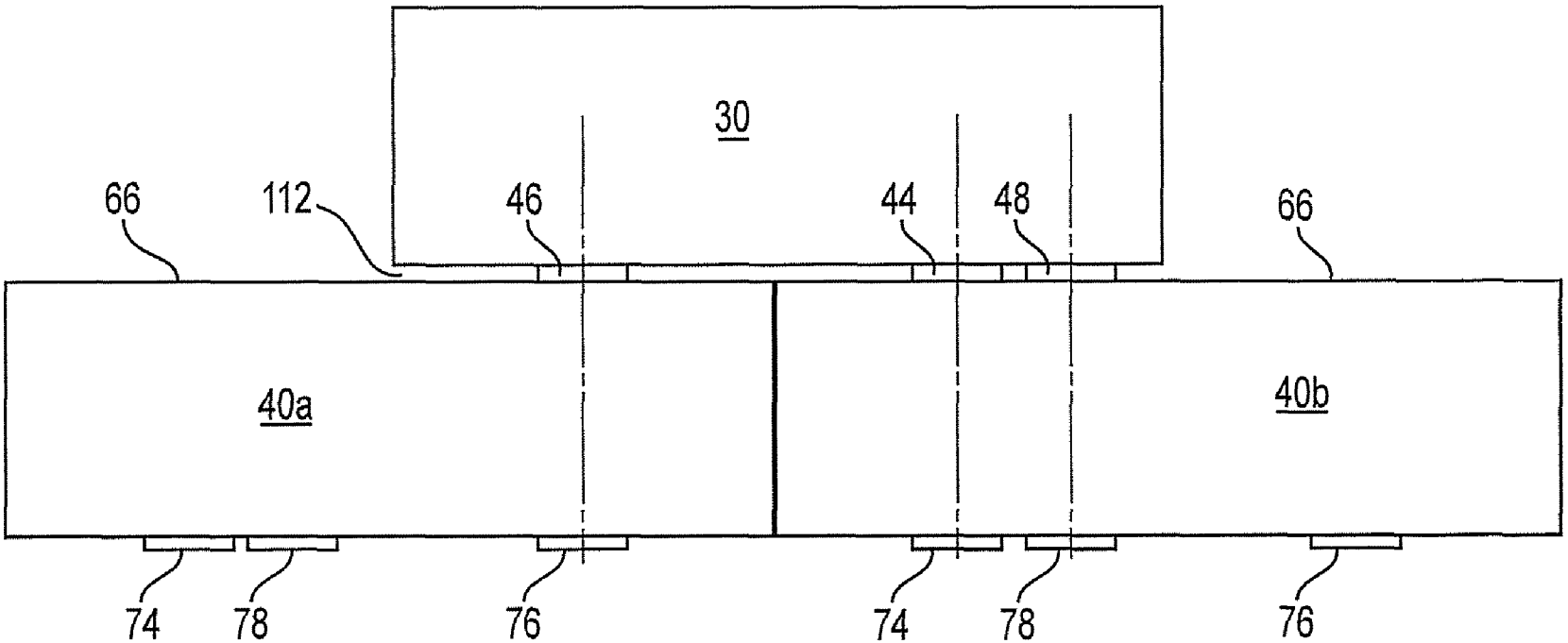
FIG. 7 is a front view of a portion of the retain wall assembly of FIG. 6.*f*

FIG. 7 is a front view illustrating a portion of retaining wall 100 of FIG. 6, in particular, left-hand blocks 60*a* and 60*b*, and right-hand block 30. As illustrated, second leveling pad 46 of right-hand block 30 aligns with second leveling pad 76 of first left-hand block 60*a*, and first and third leveling pads 44 and 48 of right-hand block 30 respectively align with first and third leveling pads 74 and 78 of second left-hand block 60*b*. Additionally, leveling pads 44, 46, and 48 of right-hand block 30 rest on top surfaces 66 of left-hand blocks 60*a* and 60*b* and create a gap 112 there between, in which debris may be present without affecting the contact between right-hand block 30 and left-hand blocks 60*a* and 60*b*.

Figure 8:
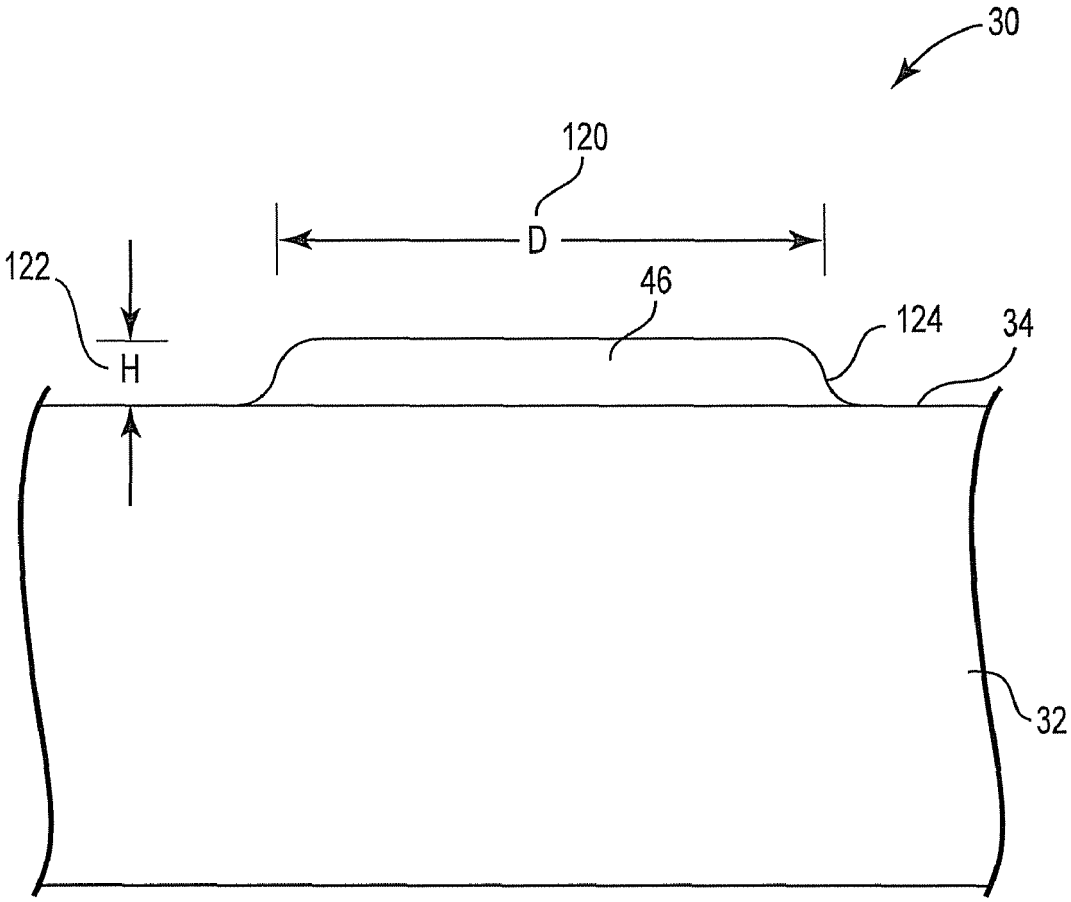
FIG. 8 is a side view of a portion of the block of FIG. 1 illustrating a leveling pad according to one embodiment.

FIG. 8 is a side view of a portion of right hand block 40 and illustrates the leveling pads, such as leveling pad 46, in greater detail. As illustrated, leveling pad 46 has a diameter D 120 and extends from lower surface 34 so as to have a height H 122. In one embodiment, as illustrated at 124, the edges of leveling pad 35 are radiused or rounded, which reduces the occurrence of chipping during assembly of structures and also assists during the manufacturing of the blocks. Although illustrated herein as being round or circular in shape, it is noted that leveling pads can be of any shape (e.g. rectangular, oval, etc.) and size (e.g. 1-inch diameter, 2-inch diameter, 3-inch diameter, etc; 0.125-inch height, 0.250-inch height, etc.). The size, shape, and configuration of the three leveling pads of each block can vary for a given block depending on factors such as the shape, size, and function of the associated masonry blocks, for example.

Figure 9:
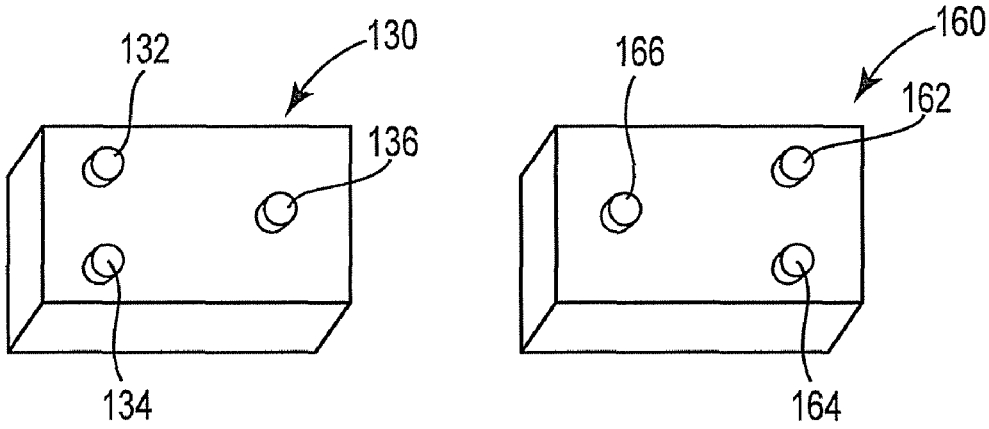
FIG. 9 illustrates generally an example of a pair of right- and left-hand blocks according to another embodiment.

Additionally, it is noted that the 3-point leveling/loading system described herein can be applied to any number of block types and configurations. For example, FIG. 9 illustrates bottom views of a pair of right and left hand blocks 130 and 160, and which are simply rectangular in shape. In the example of FIG. 9, right hand block 130 includes leveling pads 132, 134, and 136 which will respectively and vertically align with leveling pads 162, 164, and 166 of left hand block 160 when right and left hand blocks 130 and 160 are assembled in a running bond configuration to form a retaining wall or other structure.

Figure 10:
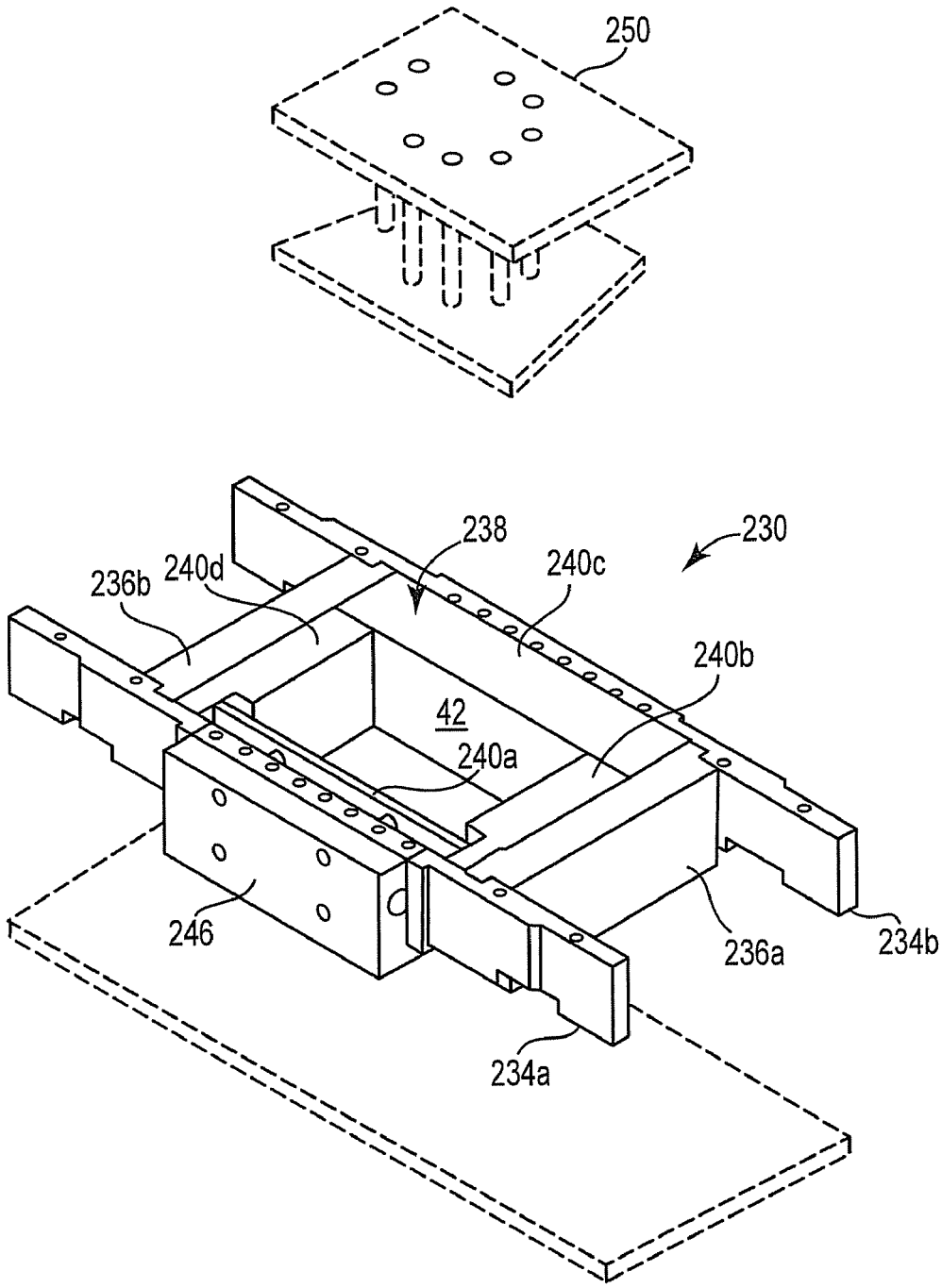
FIG. 10 illustrates a mold assembly suitable for making wall blocks according to one embodiment.

FIG. 10 is a perspective view illustrating one embodiment of a mold assembly 230 suitable for forming dry cast concrete blocks having leveling pads, such as right- and left-hand blocks 30 and 60, and right- and left-hand blocks 130 and 160 described above. Mold assembly 230 is adapted for use in an automated concrete block machine, such as those machines manufactured by Besser Company (Alpena, Mich.) and Columbia Machine, Inc. (Vancouver, Wash.), for example. Mold assembly 230 includes a mold frame having side-members 234*a*, 234*b* and cross-members 236*a*, 236*b* which are coupled to one another to form a mold box 238. A plurality of liner plates 240, illustrated as liner plates 240*a*, 240*b*, 240*c*, and 240*d* are positioned within mold box 238 to from a mold cavity 242, wherein the plurality of liner plates are positioned to provide mold cavity 242 with a desired shape of a dry cast concrete block to be formed therein, such as right-hand block 130, for example.

According to one embodiment, liner plate 240*a* is moveable between a retracted and a desired extended position within mold box 238 using a drive or actuator assembly 246, while liner plates 240*b*, 240*c*, and 240*d* are stationary. In other embodiments, all liner plates 240*a*-240*d* are stationary.

In operation, mold assembly 230 is configured to selectively couple to an automated concrete block machine which, for ease of illustration, is not shown in FIG. 10. In one embodiment, mold assembly 230 is mounted to the automated concrete block machine by bolting side members 234*a*, 234*b* to the concrete block machine. Mold assembly 230 further includes a head shoe assembly 250 having dimensions similar to those of mold cavity 246 and which is also selectively coupled to the automated concrete block machine. During formation of a dry cast masonry block, head shoe assembly 250 and a pallet 252 respectively form a top and a bottom of mold cavity 242.

Examples of embodiments of mold assemblies suitable for use as mold assembly 230 are described in greater detail by U.S. Pat. No. 7,262,548, assigned to the same assignee as the present invention, which is herein incorporated by reference.

Figure 11A:
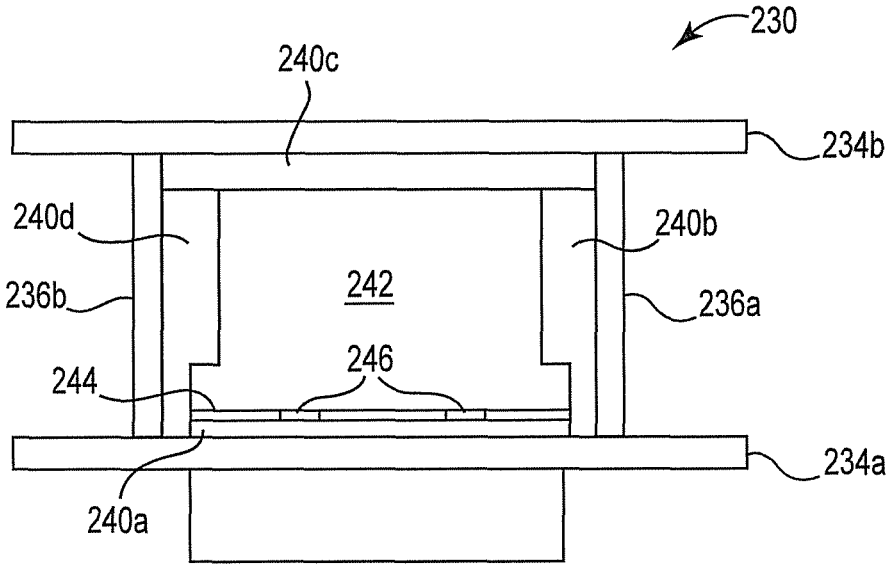
FIGS. 11A and 11B are top views illustrating an example of a mold assembly for forming a block according to one embodiment.
Figure 11B:
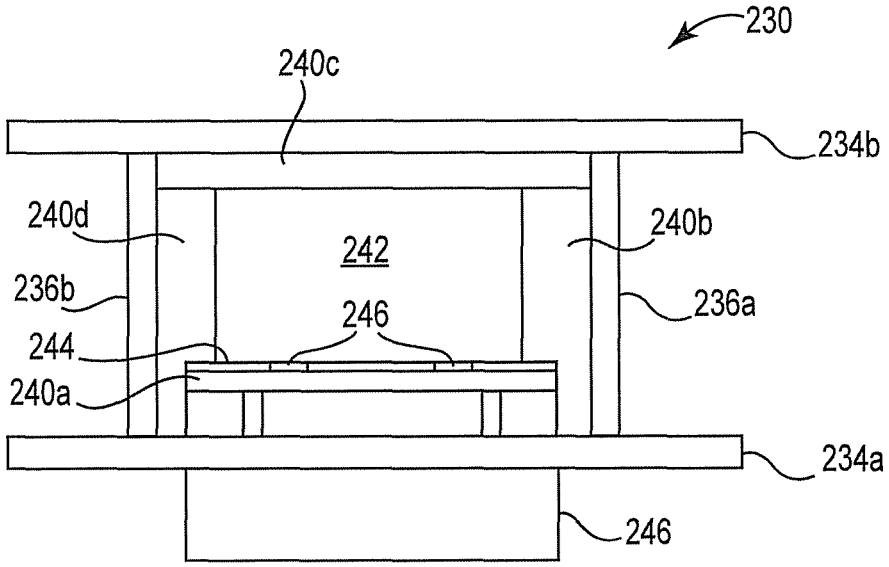

FIGS. 11A and 11B are simplified illustrations of mold assembly 230 of FIG. 10 and illustrate one embodiment of the formation of right hand block 130 of FIG. 9. FIG. 11A is top view of mold assembly 230 showing moveable liner plate 240*a* in the retracted position. After moveable liner plate 240*a* is moved to the extended position, as illustrated by FIG. 11B, mold cavity 242 is filled with concrete, and head shoe assembly 250 is moved downward to mold cavity 242.

The automated concrete block machine in which mold assembly 230 is installed (not shown) then vibrates mold assembly 230 and head shoe assembly 250 compresses the concrete within mold cavity 242. Circular cavities 246 within a liner face 244 of moveable liner plate 240*a* are filled with concrete during this process and form leveling pads 132, 134, and 136 in the top surface of right-hand block 130. Upon completion of the compaction and vibrating process, moveable liner plate 240*a* is moved to the retracted position, and the formed right-hand block 130 is expelled from mold cavity 242 via movement of head shoe assembly 250 and pallet 252.

As illustrated by FIGS. 11A and 11B, the top surface of right-hand block 130 is formed by moveable liner plate 240*a* with either its front or rear surface being formed by head shoe assembly 250. According to other embodiments, as illustrated by FIGS. 12A and 12B, all of the liner plates 240*a*-240*d* are stationary, and the top surface of right-hand block 130 is formed by head shoe assembly 250 with the bottom surface of right-hand block 130 resting on pallet 252.

Figure 12A:
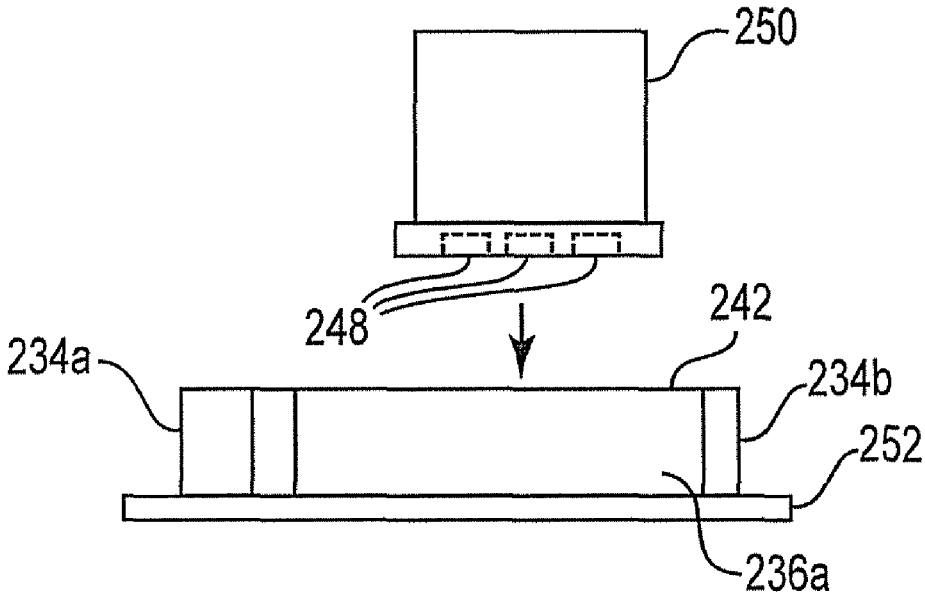
FIGS. 12A and 12B are top views illustrating an example of a mold assembly for forming a block according to one embodiment.
Figure 12B:
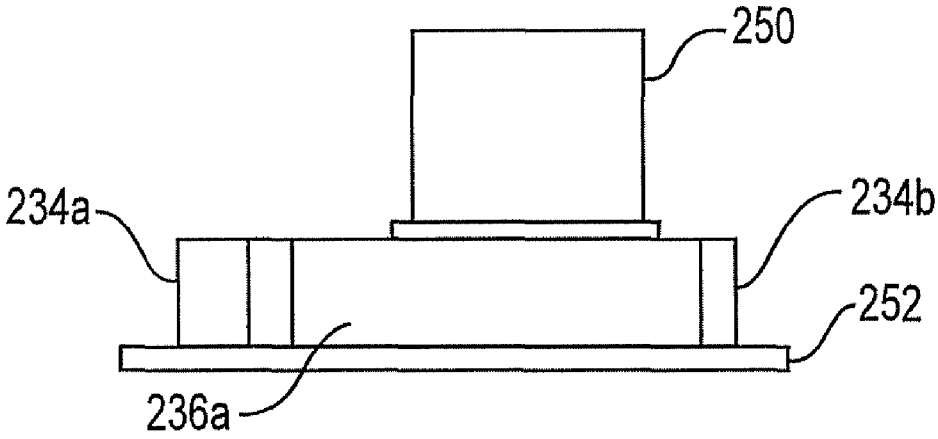

FIG. 12A illustrates head shoe assembly 250 in a retracted position above mold cavity 242, wherein mold cavity 242 is filled with concrete. Head shoe assembly 250 is then moved downward to close the top of mold cavity 242, and the automated concrete block machine in which mold assembly 230 is installed (not shown) vibrates mold assembly 230 while head shoe assembly 250 compresses the concrete within mold cavity 242. Circular cavities 248 within a bottom face of head shoe assembly 250 are filled with concrete during this process and form leveling pads 132, 134, and 136 in the top surface of right-hand block 130. Upon completion of the compaction and vibrating process, moveable liner plate 240*a* is moved to the retracted position, and the formed right-hand block 130 is expelled from mold cavity 242 via movement of head shoe assembly 250 and pallet 252.

From the above, it can be seen that any number of block and leveling pad configurations are possible. Additionally, although described in terms of off-set and alternating courses of blocks (a running bond pattern), it is noted that blocks and leveling pad configurations can be configured to enable vertical stacking of blocks without offsets.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A wall block system comprising:

a plurality of right-hand blocks, each right-hand block having a set of three leveling pads extending from a bottom surface; and a plurality of left-hand blocks, each left-hand block having a set of three leveling pads extending from a bottom surface, the right-hand and left-hand blocks having the same dimensions, wherein when arranged in alternating courses of right-hand blocks and left-hand blocks offset from one another in a running bond pattern to form a wall structure, the three leveling pads of each of the right-hand blocks and each of the left-hand blocks are configured to align with corresponding leveling pads from two abutting blocks in a course of blocks immediately above the block and to align with corresponding leveling pads from two abutting blocks in a course of blocks immediately below the block;

wherein each right-hand block and each left hand block has a top surface opposite the bottom surface, a front surface and a rear surface opposite the front surface which extend between the top and bottom surfaces, and a first side surface and a second side surface opposite the first side surface and which extend between the front and rear surfaces, and wherein:

each right-hand block has a first leveling pad a first distance from the first side surface, a second leveling pad a second distance from the second side surface, and a third leveling pad a third distance from the first side surface, and each left-hand block has a first leveling pad at the first distance from a centerline of the left-hand block toward the second side surface, a second leveling pad at the second distance from the centerline toward the first surface, and a third leveling pad at the third distance from the centerline toward the second side surface, and wherein the first and third leveling pads of a right-hand block align with the first and third leveling pads of one left-hand block of a pair of abutting left hand blocks in a course of blocks immediately below the right-hand block, and the second leveling pad of the right-hand block aligns with the second leveling pad of the other left-hand block of the pair of abutting left hand blocks in the course of blocks immediately below the right-hand block.

2. The wall block system of claim 1, wherein the leveling pads of each of the right-hand and left-hand blocks are arranged in a triangular pattern.

3. The wall block system of claim 1, wherein the leveling pads of each right-hand and left-hand block form a gap between the bottom surface of the block and the top surfaces of two abutting blocks on which the leveling pads rest.

4. The wall block system of claim 1, wherein each of the leveling pads is circular in shape.

5. The wall block system of claim 1, wherein perimeter edges of the leveling pads are chamfered to reduce chipping.

6. The wall block system of claim 1, wherein the right-hand and left hand blocks comprise retaining wall blocks.

7. The wall block system of claim 1, wherein the right-hand and left hand blocks comprise dry cast masonry blocks.

8. A wall block system comprising:

a plurality of right-hand blocks and a plurality of left-hand blocks stacked in alternating and offset courses in a running bond pattern to form a wall structure, wherein bottom faces of the blocks of one course are stacked on tops faces of the blocks of a next lower course;

each right-hand block having a plurality of leveling pads extending from a bottom face of the block, wherein the plurality of leveling pads includes a first number of leveling pads disposed on a right-hand half of the block and a second number of leveling pads disposed on a left-hand half of the block when viewing the block from a front face, the first number being greater than the second number; and each left-hand block having a plurality of leveling pads extending from a bottom face of the block, wherein the plurality of leveling pads includes the first number of leveling pads disposed on a left-hand half of the block and the second number of leveling pads disposed on a right-hand half of the block when viewing the block from a front face, wherein the first number of leveling pads on the right-hand halves of right hand blocks are configured to vertically align with the first number of leveling pads on the left-hand halves of left-hand blocks and the second number of leveling pads on the left-hand halves of right-hand blocks are configured to vertically align with the second number of leveling pads on the right-hand halves of left-hand blocks when stacked to form the wall structure.

9. The wall block system of claim 8, wherein the first number is two and the second number is one.

* * * * *